US008459893B2

(12) United States Patent
Henderson et al.

(10) Patent No.: US 8,459,893 B2
(45) Date of Patent: Jun. 11, 2013

(54) BINDING ASSEMBLY

(75) Inventors: James Henderson, Lower Wick (GB); Kester Rudd, Worcester (GB); Hugh Darcy, Bromyard (GB)

(73) Assignee: Fellowes, Inc., Itasca, IL (US)

( * ) Notice: Subject to any disclaimer, the term of this patent is extended or adjusted under 35 U.S.C. 154(b) by 276 days.

(21) Appl. No.: 12/984,282

(22) Filed: Jan. 4, 2011

(65) Prior Publication Data

US 2012/0170968 A1 Jul. 5, 2012

(51) Int. Cl.
*B42F 13/00* (2006.01)

(52) U.S. Cl.
USPC ..... 402/75

(58) Field of Classification Search
USPC ..... 402/19–37, 75; 281/12
See application file for complete search history.

(56) References Cited

U.S. PATENT DOCUMENTS

| | | | | |
|---|---|---|---|---|
| 788,023 | A | 4/1905 | Couch et al. | |
| 1,758,327 | A | 5/1930 | Lotter | |
| 1,786,617 | A | 12/1930 | Hutchings | |
| 2,000,184 | A | 5/1935 | Lotter | |
| 2,024,461 | A | 12/1935 | Lotter | |
| 2,104,046 | A | 1/1938 | Krag | |
| 2,211,546 | A | 8/1940 | Rabinof | |
| 2,212,380 | A | 8/1940 | Steele | |
| 2,252,422 | A | 8/1941 | Unger | |
| 2,252,926 | A * | 8/1941 | Hanna | 402/26 |
| 2,440,945 | A | 5/1948 | Hanna | |
| 2,543,866 | A | 3/1951 | Panfil, Sr. | |
| 2,817,341 | A | 12/1957 | Schade | |
| 3,833,308 | A | 9/1974 | Seaborn | |
| 5,118,213 | A | 6/1992 | Meservy et al. | |
| 5,338,125 | A | 8/1994 | Forsse et al. | |
| 5,667,324 | A | 9/1997 | Aoki | |
| D389,183 | S | 1/1998 | Chan | |
| 5,716,153 | A | 2/1998 | Aiello | |
| D392,997 | S | 3/1998 | Chan | |
| 5,827,004 | A | 10/1998 | Kim | |
| 5,846,013 | A | 12/1998 | To | |
| D405,113 | S | 2/1999 | Ko | |
| D408,851 | S | 4/1999 | To | |
| D409,240 | S | 5/1999 | Ko | |
| D426,571 | S | 6/2000 | To | |
| D430,898 | S | 9/2000 | To | |
| 6,126,353 | A | 10/2000 | Mullin et al. | |
| D433,445 | S | 11/2000 | To | |
| D434,071 | S | 11/2000 | To | |
| D436,993 | S | 1/2001 | Whaley | |
| D442,223 | S | 5/2001 | To | |

(Continued)

*Primary Examiner* — Dana Ross
*Assistant Examiner* — Matthew G Katcoff
(74) *Attorney, Agent, or Firm* — Pillsbury Winthrop Shaw Pittman LLP

(57) ABSTRACT

A binder assembly for receiving and retaining articles and that includes a cover having a spine portion and at least one cover leaf portion and a first binder element and a second binder element having a plurality of first and second retaining fingers, respectively. The first and second binding elements are moveable between 1) an open position wherein articles are permitted to be removed from or mounted to the binder assembly, and 2) a closed position wherein articles mounted to the binder assembly are prevented from being removed. The binder assembly further includes an elongated retainer/lock constructed to releasably attach to the first and second binding elements in the closed position thereof with the spine portion of the cover therebetween for locking the first and second binding elements in the closed position and securing the first and second binding elements to the spine portion of the cover.

30 Claims, 18 Drawing Sheets

U.S. PATENT DOCUMENTS

| | | | |
|---|---|---|---|
| D448,045 | S | 9/2001 | Ko |
| D451,135 | S | 11/2001 | Whaley |
| D451,954 | S | 12/2001 | Kaneda |
| D457,559 | S | 5/2002 | To |
| D459,392 | S | 6/2002 | Xu |
| D460,109 | S | 7/2002 | To |
| 6,758,621 | B2 | 7/2002 | To |
| D461,497 | S | 8/2002 | To |
| 6,467,984 | B1 | 10/2002 | To |
| D473,897 | S | 4/2003 | To |
| D479,267 | S | 9/2003 | Ko |
| 6,962,457 | B2 | 11/2005 | Forsse |
| D561,826 | S | 2/2008 | Lynen et al. |
| D582,477 | S | 12/2008 | To |
| D585,935 | S | 2/2009 | To |
| D591,344 | S | 4/2009 | Tanaka et al. |
| D598,494 | S | 8/2009 | To |
| 7,607,853 | B2 | 10/2009 | Busam et al. |
| 7,637,682 | B2 | 12/2009 | To |
| 7,674,062 | B2 | 3/2010 | Horn |
| D616,934 | S | 6/2010 | To |
| D622,316 | S | 8/2010 | To |
| D626,023 | S | 10/2010 | To |
| D657,418 | S | 4/2012 | Henderson et al. |
| 2001/0026726 | A1 | 10/2001 | To |
| 2004/0013463 | A1 | 1/2004 | To |

* cited by examiner

BINDING ASSEMBLY

BACKGROUND OF THE INVENTION

1. Field of Invention

The present invention is generally related to a binding assembly for retaining articles, such as paper.

2. Background

Binding mechanisms are generally known in the art to retain sheets of paper or other articles. The binding mechanisms may be provided in books, notebooks, folders, or other components to retain the papers or other articles therein. For example, binders typically include a plurality of rings which can be selectively opened and closed to allow papers to be inserted into and removed from the binder. The plurality of rings typically retain separate back and cover portions therein. Alternatively, the plurality of rings may be fixed to a single cover portion. In addition, some existing binding mechanisms may comprise components that are difficult to align and engage to retain the articles therein. Thus, these existing binding mechanisms may be difficult to operate and expensive to manufacture. Furthermore, the existing binding mechanisms may lack secure connections, versatility, and/or modularity.

SUMMARY OF THE INVENTION

One aspect of the invention provides a binder assembly for receiving and retaining at least one article with holes formed along an edge thereof. The binder assembly includes a cover comprising a spine portion and at least one cover leaf portion and a first binder element comprising a plurality of first retaining fingers. The binder assembly also includes a second binder element comprising a plurality of second retaining fingers. The plurality of first and second retaining fingers are arranged to define a plurality of opposing pairs of the first and second retaining fingers. The first binding element and the second binding element are moveable between 1) an open position wherein ends of the first and second retaining fingers of each pair are disengaged and spaced apart from one another to permit the at least one article to be removed from or mounted to the binder assembly by engaging or disengaging the holes and the first and second retaining fingers, and 2) a closed position wherein the ends of the first and second retaining fingers of each pair are engaged together to prevent the at least one article mounted to the binder assembly from being removed. The binder assembly further includes an elongated retainer/lock constructed to releasably attach to the first and second binding elements in the closed position thereof with the spine portion of the cover therebetween for locking the first and second binding elements in the closed position and securing the first and second binding elements to the spine portion of the cover.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
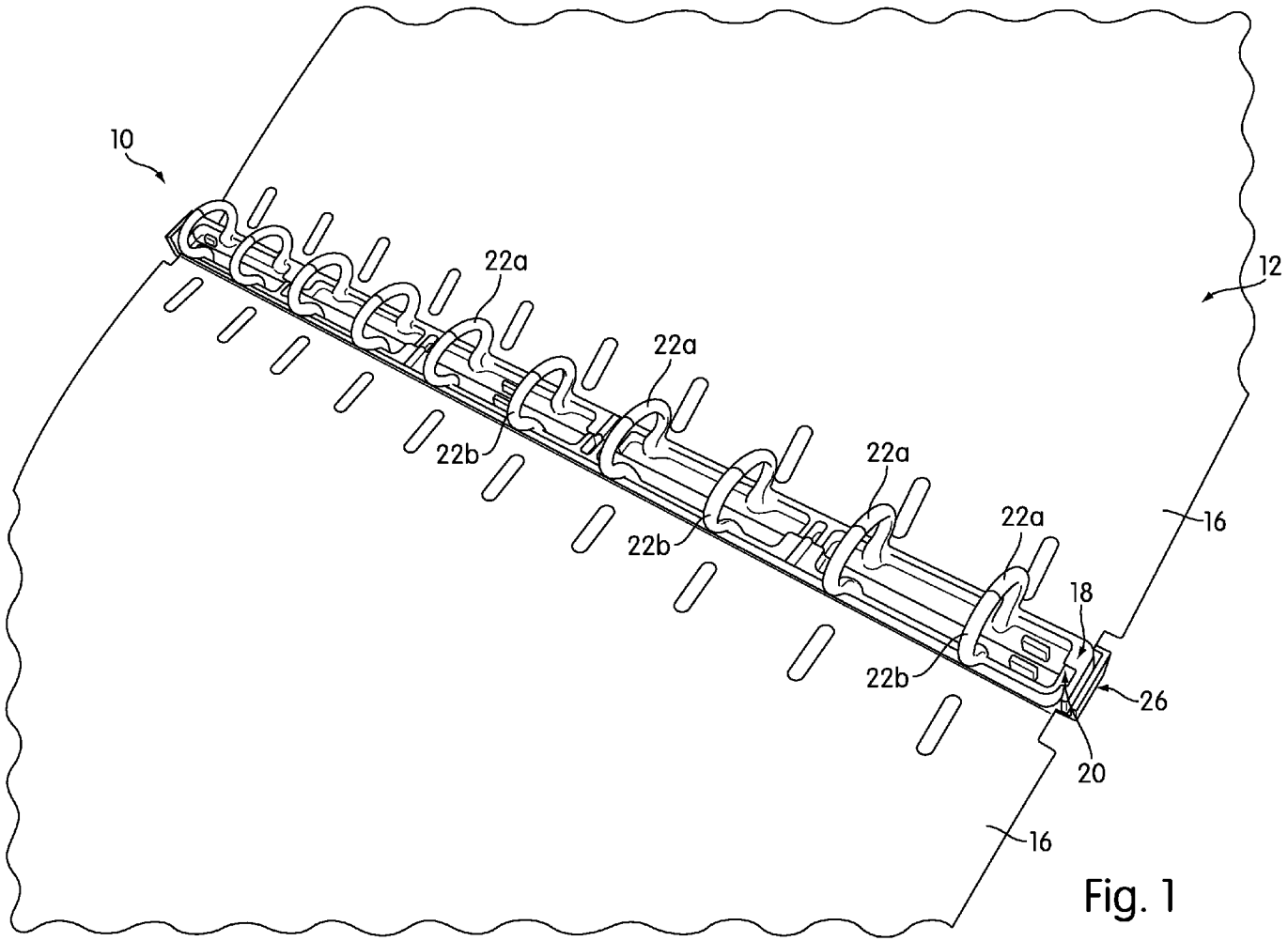
FIG. 1 is a perspective view of binding elements of a binder assembly in accordance with an embodiment.

FIG. 1 illustrates an embodiment of a binder assembly 10 for receiving and retaining at least one article with holes formed along an edge thereof. The binder assembly 10 includes a cover 12 having a spine portion 14 (shown in FIG. 9*a*) and at least one cover leaf portion 16 (two are shown in this embodiment). The cover leaf portions 16 may be integrally formed with the spine portion 14 or may be separate pieces attached to the spine portion 14. A living hinge 15 (see FIG. 9*a*) may be provided at the connection between the spine portion 14 and the cover leaf portions 16 so as to enable the cover leaf portions 16 to be pivoted relative to the spine portion 14 between an open position (shown in this Figure) wherein access to the articles 11 retained by the binder assembly 10 is permitted, and a closed position wherein access to the articles 11 retained by the binder assembly 10 is prevented (see FIG. 10*a*). In embodiments where the cover leaf portions 16 and the spine portion 14 are separate components, it is contemplated that other types of hinges may also be used.

Referring back to FIG. 1, the binder assembly 10 also has a first binder element 18 and a second binder element 20. The first binder element 18 has a plurality of first retaining fingers

22*a*. The second binder element 20 has a plurality of second retaining fingers 22*b*. The plurality of first and second retaining fingers 22*a*, 22*b* are arranged to define a plurality of opposing pairs of the first and second retaining fingers 22*a*, 22*b*. The first binding element 18 and the second binding element 20 are movably mounted together for movement between 1) an open position (see FIG. 2*b*) wherein ends of the first and second retaining fingers 22*a*, 22*b* of each pair are disengaged and spaced apart from one another to permit the at least one article to be removed from or mounted to the binder assembly 10 by engaging or disengaging the holes of the articles with/from the first and second retaining fingers 22*a*, 22*b*, and 2) a closed position (see FIG. 2*b*) wherein the ends of the first and second retaining fingers 22*a*, 22*b* of each pair are engaged together to prevent the at least one article 13 from being removed from or inserted into the fingers 22*a*, 22*b* of the binder assembly 10. The assembly 10 also includes an elongated retainer/lock 26 constructed to releasably attach to the first and second binding elements 18, 20 in the closed position thereof with the spine portion 14 of the cover 12 therebetween for locking the first and second binding elements 18, 20 in the closed position and for securing the first and second binding elements 18, 20 to the spine portion 14 of the cover 12.

Figure 2A:
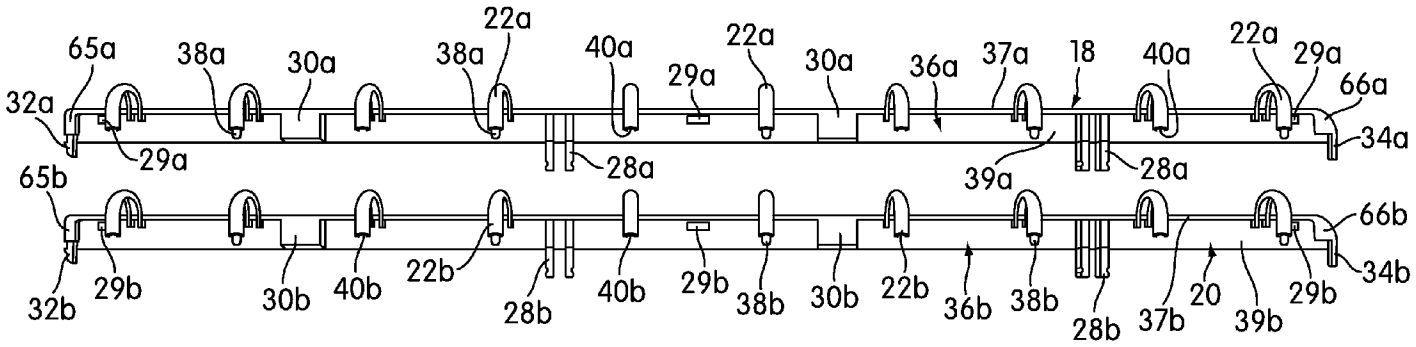
FIG. 2*a* is a perspective view of the binding elements of the binder assembly in an unassembled arrangement in accordance with an embodiment.

As shown in FIG. 2*a*, the first binding element 18 includes a main portion 36*a* having a first end 32*a* and a second end 34*a*. In this embodiment, the main portion 36*a* includes an upper portion 37*a* and a lower portion 39*a*. The first and second ends 32*a*, 34*a* may extend from the upper portion 37*a*. The transition between the upper portion 37*a* and the first and second ends 32*a*, 34*a* may be defined by a first corner 65*a* and a second corner 66*a*. The plurality of first retaining fingers 22*a* may be arranged between the first end 32*a* and the second end 34*a*.

Similarly, the second binding element 20 includes a main portion 36*b* having a first end 32*b* and a second end 34*b*. In this embodiment, the main portion 36*b* also includes an upper portion 37*b* and a lower portion 39*b*. The first and second ends 32*b*, 34*b* may extend from the upper portion 37*b*. The transition between the upper portion 37*b* and the first and second ends 32*b*, 34*b* may be defined by a first corner 65*b* and a second corner 66*b*. The plurality of second retaining fingers 22*b* may be arranged between the first end 32*b* and the second end 34*b*.

In the illustrated embodiment, the first and second retaining fingers 22*a*, 22*b* take the form of ring segments. Accordingly, when the first and second binding elements 18, 20 are in the closed position and the first and second retaining fingers 22*a*, 22*b* are engaged together, the first and second retaining fingers 22*a*, 22*b* form enclosures or rings (see FIG. 1) to prevent the at least one article mounted to the binder assembly 10 from being removed. In this embodiment, the binding elements 18, 20 are provided with ten pairs of opposing first and second retaining fingers 22*a*, 22*b*. In one embodiment, the opposing pairs of first and second retaining fingers 22*a*, 22*b* are spaced apart at a distance of about 25 mm to 30 mm. It should be appreciated that the number, shape, spacing, and arrangement of the retaining fingers 22*a*, 22*b* may be varied in other embodiments to accommodate the spacing of the holes of the articles.

The first and second retaining fingers 22*a*, 22*b* may also include either a locating pin 38*a*, 38*b* extending therefrom or a locating pin receiving structure 40*a*, 40*b* constructed and arranged to engage with the locating pins 38*a*, 38*b*. In the illustrated embodiment, alternating first retaining fingers 22*a* may be provided with the locating pin 38*a* while the other first retaining fingers 22*a* are provided with the locating pin receiving structure 40*a*. Similarly, alternating second retaining fingers 22*b* may be provided with the locating pin 38*b* while the other second retaining fingers 22*b* are provided with the locating pin receiving structure 40*b*.

As shown in the illustrated embodiment, the binding elements 18, 20 each comprises locking protrusions 28*a*, 28*b*, respectively, spaced along the length thereof. Each of the first and second binding elements 18, 20 also comprises protrusion receiving structures 30*a*, 30*b*, respectively, spaced along the length thereof. The protrusions 28*a*, 28*b* are constructed and arranged to engage with protrusion receiving structures 30*a*, 30*b* on the opposing first and second binding elements 18, 20 (see FIG. 2*b*). In this embodiment, each binding element 18, 20 includes two locking protrusions 28*a*, 28*b* and two protrusion receiving structures 30*a*, 30*b*. However, this example is not intended to be limiting and it is contemplated that the number and location of the protrusions 28*a*, 28*b* and protrusion receiving structures 30*a*, 30*b* may vary in other embodiments.

Figure 2B:
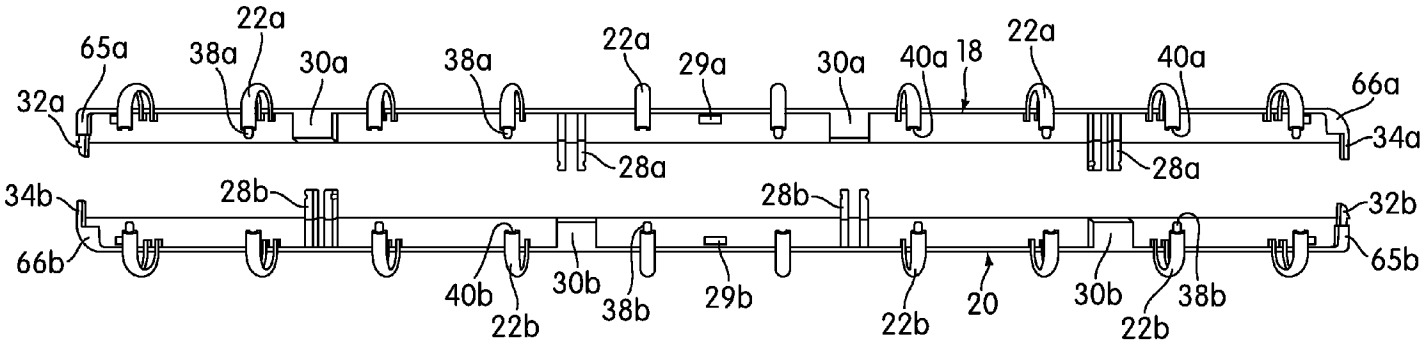
FIG. 2*b* is a perspective view of the binding elements of the binder assembly in an open position in accordance with an embodiment.

In one embodiment, the first and second binding elements 18, 20 may also be provided with a plurality of openings 29*a*, 29*b*, respectively, along the length thereof. In the embodiment shown in FIG. 2*a*, the first and second binding elements 18, 20 each have three openings 29*a*, 29*b*. The openings 29*a* may be aligned with the openings 29*b* when the first and second binding elements 18, 20 are in the open position and facing each other, as shown in FIG. 2*b*. The openings 29*a*, 29*b* may be constructed and arranged to receive portions of the retainer/lock 26.

In the embodiment shown in FIG. 2*a*, the first binding element 18 and the second binding element 20 are constructed and arranged in a similar manner. That is, the fingers 22*a*, the protrusions 28*a*, and the protrusion receiving structures 30*a* of the first binding element 28 are constructed and arranged similarly as those of the second binding element 20. Thus, the first and second binding elements 18, 20 may be inexpensive and easy to manufacture. Any combination or all of the components of the first and second binding elements 18, 20 may be made of plastic material. Any combination or all of the components may also be made of integrally molded plastic. It is contemplated that the components of the first and second binding elements 18, 20 may also be made of other materials or may be separately attached together to form the first and second binding elements 18, 20.

FIG. 2*b* shows the first and second binding elements 18, 20 facing each other in the open position. Although the first and second binding elements 18, 20 have the same construction and arrangement (as shown in FIG. 2*a*), the first and second binding elements 18, 20 may be positioned to face each other (e.g., the second binding element 20 may be flipped from its position shown in FIG. 2*a*) such that the protrusions 28*a*, 28*b* of each binder element 18, 20 is aligned with the protrusion receiving structure 30*a*, 30*b* of the other binder element 18, 20. In such an arrangement, the first end 32*a* of the first binder element 18 is aligned with the second end 34*b* of the second binder element 20, and the second end 34*a* of the first binder element 18 is aligned with the first end 32*b* of the second binder element 18. In addition, the locating pins 38*a* of the first retaining fingers 22*a* are aligned with the locating pin receiving structures 40*b* of the second retaining fingers 22*b*, and the locating pin receiving structures 40*a* of the first retaining fingers 22*a* are aligned with the locating pins 38*b* of the second retaining fingers 22*b*.

Figure 3A:
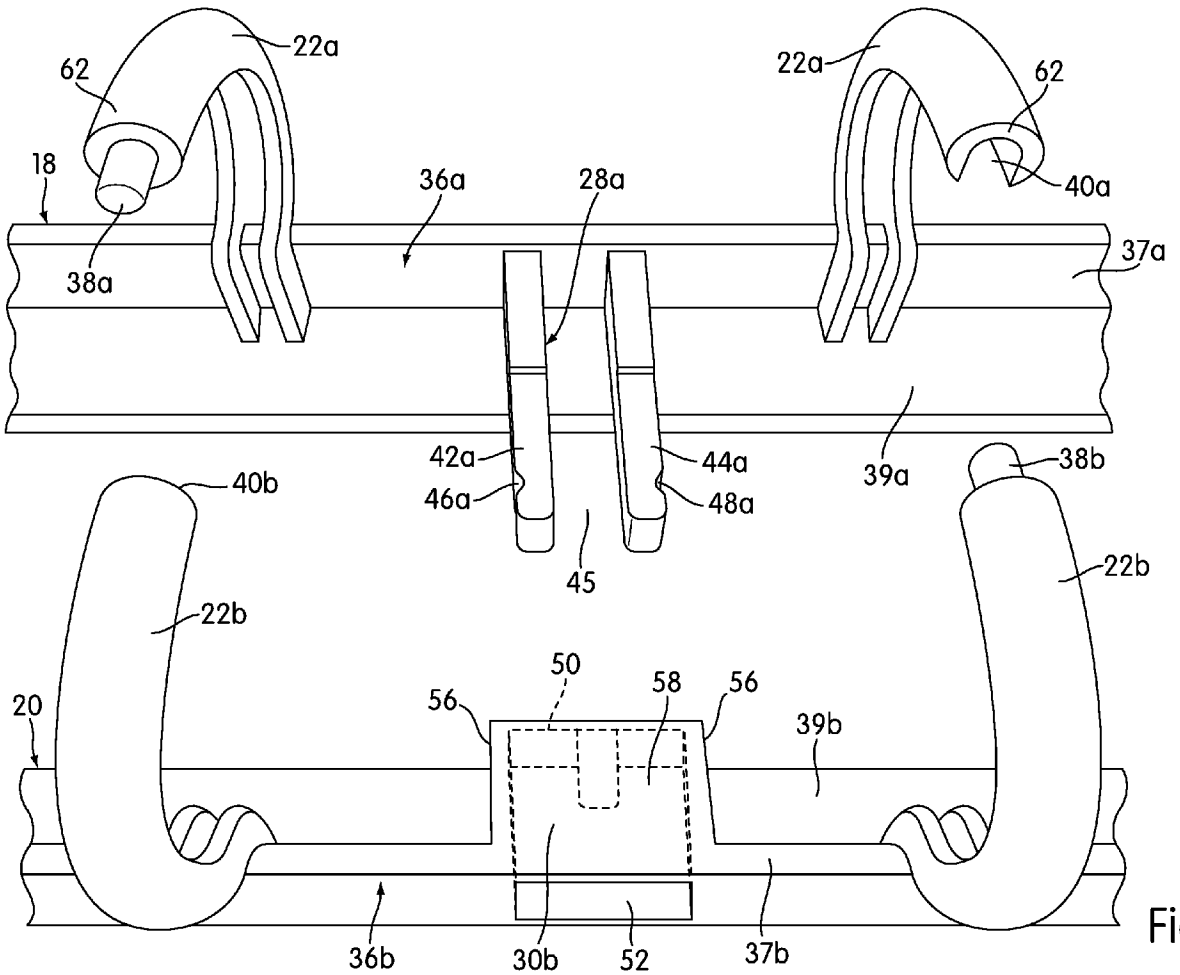
FIG. 3*a* is a detailed view of components of the binder assembly in the open position in accordance with an embodiment.

FIG. 3*a* illustrates the locking protrusion 28*a* of the first binding element 18 and the protrusion receiving structure 30*b* of the second binding element 20 in more detail. The locking protrusion 28*a* includes two prongs 42*a*, 44*a* extending from the upper portion 37*a*. In the illustrated embodiment, the two prongs 42, 44*a* are generally parallel with a space 45 therebetween. Each prong 42*a*, 44*a* may also be provided with an indentation 46*a*, 48*a*, respectively, at an end opposite the end attached to the upper portion 37*a*. The indentation 46*a*, 48*a* may be positioned to face away from each other. The locking protrusion 28*a* may be made of resilient plastic material.

Figure 3B:
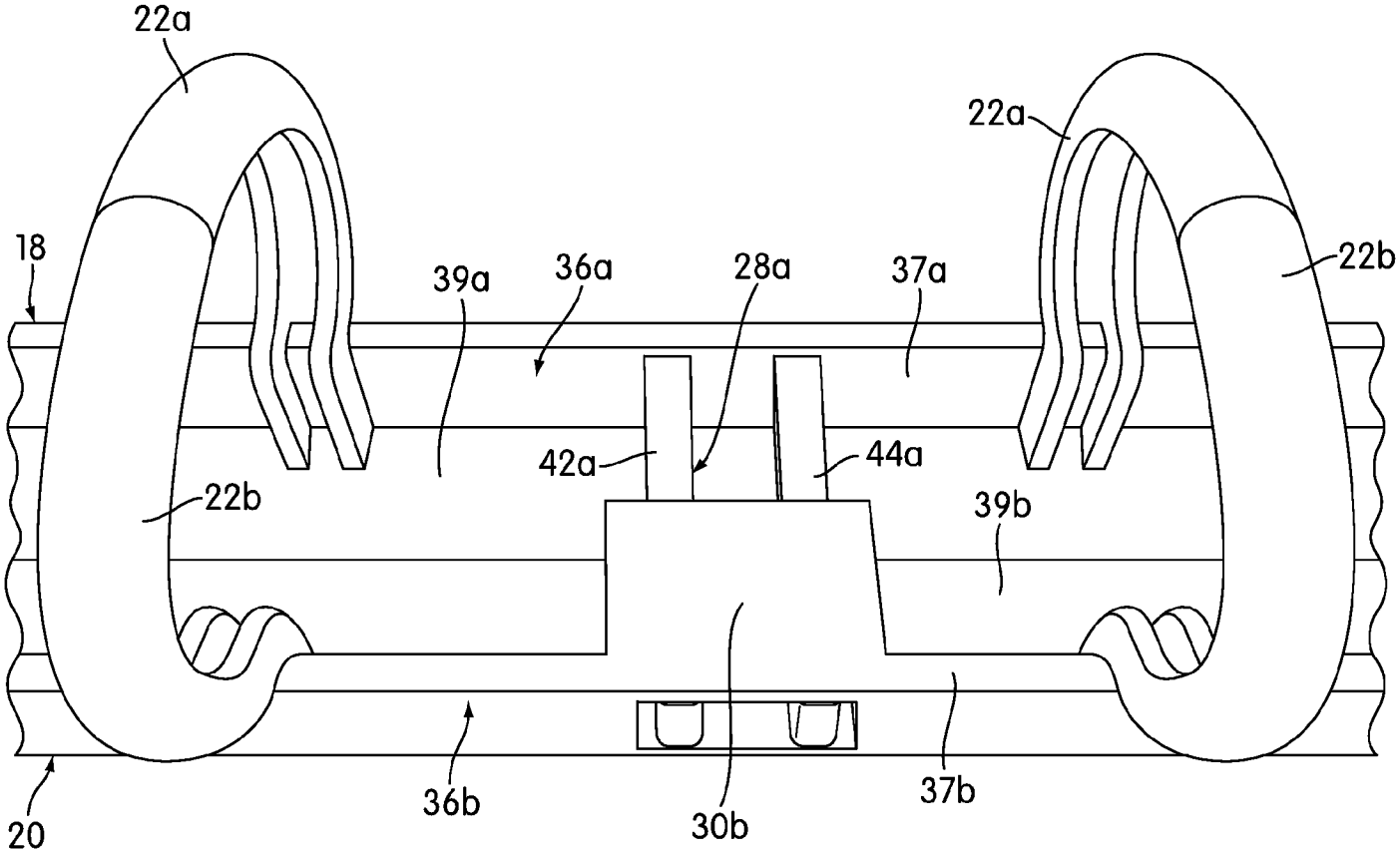
FIG. 3*b* is a detailed view of the components of the binder assembly in the closed position in accordance with an embodiment.
Figure 3C:
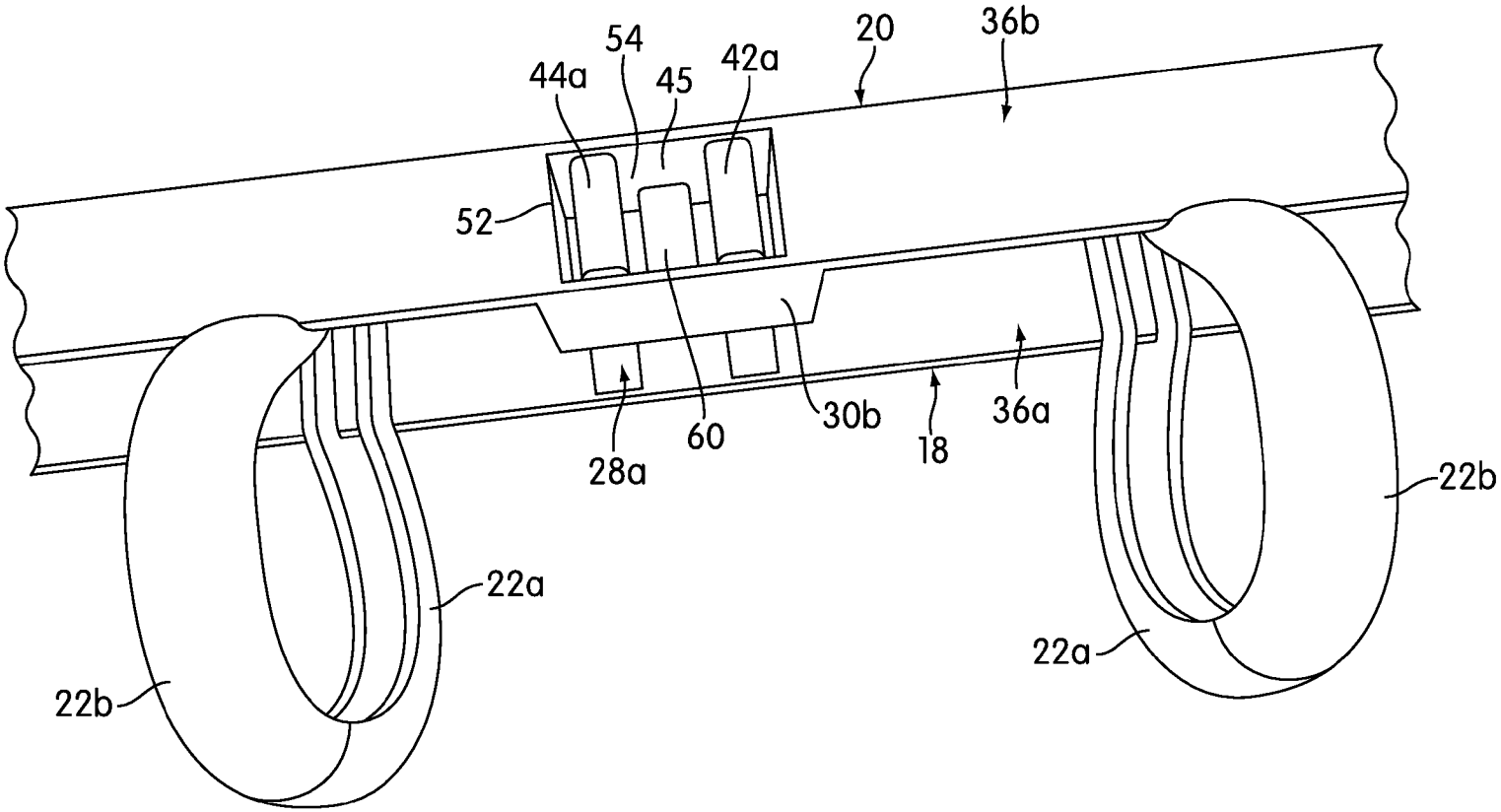
FIG. 3*c* is a detailed view of the components of the binder assembly in the closed position in accordance with an embodiment.

The two prongs 42*a*, 44*a* may be constructed and arranged to be received in a front opening 50 formed in the protrusion receiving structure 30*b*. The protrusion receiving structure 30*b* may also include a rear opening 52 communicating with the front opening 50 through a space 54 (see FIG. 3*c*) provided in the protrusion receiving structure 30*b*. Referring back to FIG. 3*a*, the front opening 50, the rear opening 52, and the space 54 may be defined by the lower portion 39*b* and two side walls 56 and an upper wall 58 of the protrusion receiving structure 30*b*. A divider 60 (see FIG. 3*c*), taking the form of a vertical structure extending between the upper wall 58 and the lower portion 39*b* in this embodiment, may be provided in the space 54 of the protrusion receiving structure 30*b*. Accordingly, the divider 60 may be received in the space 45 between the prongs 42*a*, 44*a* when the protrusion 28*a* is engaged with the protrusion receiving structure 30*b*, as shown in FIG. 3*c*. In one embodiment, retaining structures (not shown) may extend from the side walls 56 into the space 54 of the protrusion receiving structure 30*b*. Thus, the retaining structures may be constructed and arranged to engage with the indentations 46*a*, 48*a* provided on the prongs 42*a*, 44*a* so as to retain the prongs 42*a*, 44*a* of the locking protrusion 28*a* within the protrusion receiving structure 30*b*.

As mentioned above, the locking protrusion 28*a* and protrusion receiving structure 30*a* of the first binding element 18 may be similarly constructed and arranged as the locking protrusion 28*b* and the protrusion receiving structure 30*b* of the second binding element 20. Thus, the locking protrusion 28*b* of the second binding element 20 may have prongs 42*b*, 44*b* with indentations 46*b*, 48*b* formed therein. The protrusion receiving structure 30*a* of the first binding element 20 may also have side walls 56, the rear opening 52, and other similar components as the protrusion receiving structure 30*b* of the second binding element 20 described above.

Referring back to FIG. 3*a*, the retaining fingers 22*a*, 22*b* may be hollow with a generally arcuate surface. With respect to the retaining fingers 22*a*, 22*b* having the locating pin receiving structures 40*a*, 40*b*, a front end 62 of the arcuate surface of the retaining fingers 22*a*, 22*b* may define the locating pin receiving structures 40*a*, 40*b*, which takes the form of openings in this embodiment. With respect to the retaining fingers 22*a*, 22*b* having the locating pins 38*a*, 38*b*, the locating pin 38*a*, 38*b* may be constructed to extend from the front end 62 of the retaining fingers 22*a*, 22*b*. In the illustrated embodiment, the locating pins 38*a* of the retaining fingers 22*a* are aligned with the locating pin receiving structures 40*b* of the second retaining fingers 22*b*, and the locating pin receiving structures 40*a* of the first retaining fingers 22*a* are aligned with the locating pins 38*b* of the second retaining fingers 22*b*. Accordingly, the locating pin 38*a*, 38*b* may be received in the locating pin receiving structures 40*a*, 40*b* of the retaining fingers 22*a*, 22*b* when the first and second binding elements 18, 20 are engaged, as shown in FIG. 3*b*. The locating pins 38*a*, 38*b* and the locating pin receiving structures 40*a*, 40*b* may be constructed and arranged as such to keep the retaining fingers 22*a*, 22*b* engaged and aligned, thus preventing articles from being removed from or inserted between the retaining fingers 22*a*, 22*b*.

Figure 4A:
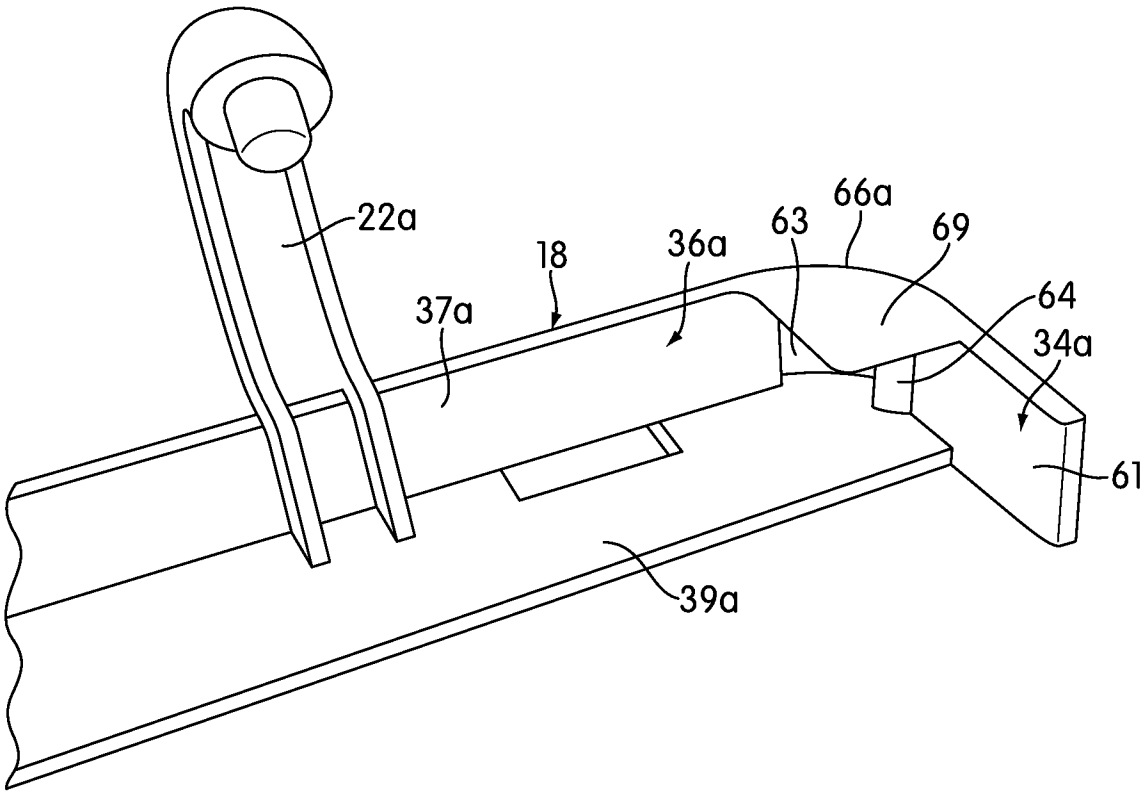
FIG. 4*a* is a detailed view of an end of the binder assembly in accordance with an embodiment.

FIG. 4*a* shows the second end 34*a* of the first binding element 18 in more detail. As shown in FIG. 4*a*, the second end 34*a* may take the form of a lip 61 extending from the upper portion 37*a* of the main portion 36*a*. An opening 63 may be provided between the second end 34*a* and the upper portion 37*a* of the main portion 36*a* at the corner 66*a*. An engaging member, taking the form of a vertical ridge 64 in this embodiment, may be provided near the second corner 66*a* of the main portion 36*a*. In addition, an overhang 69 may extend from the second corner 66*a* above the ridge 64.

Figure 4B:
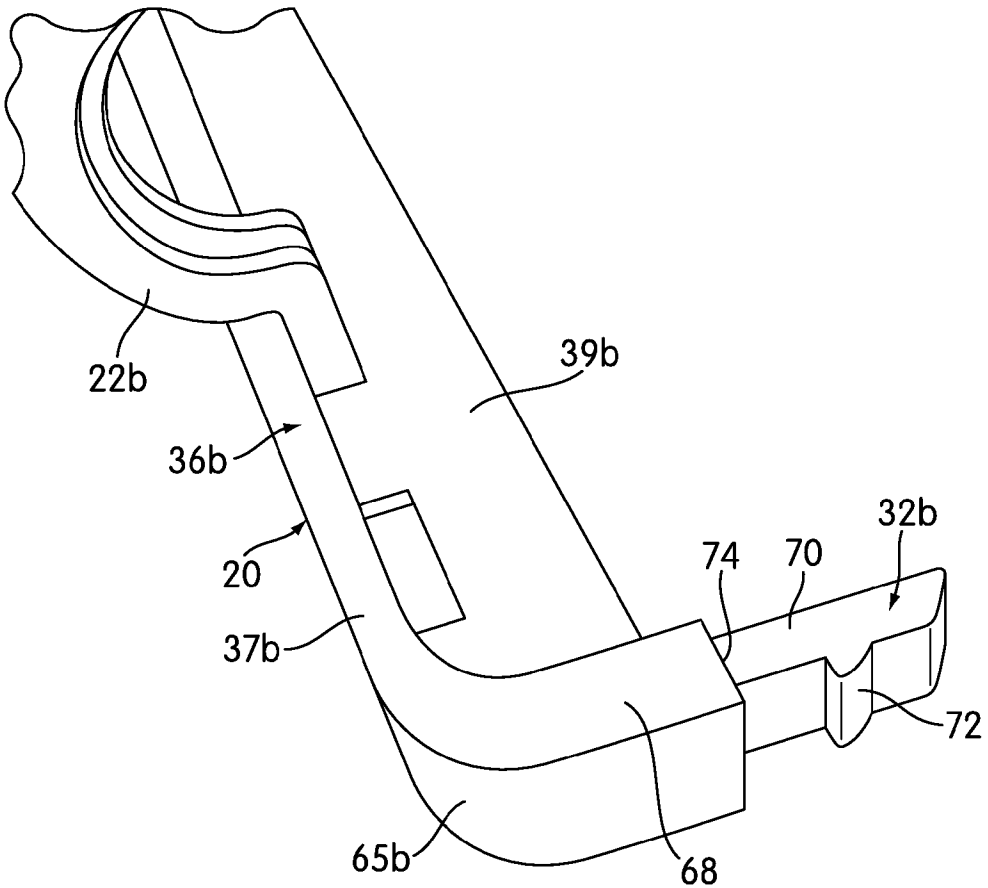
FIG. 4*b* is a detailed view of another end of the binder assembly in accordance with an embodiment.
Figure 5A:
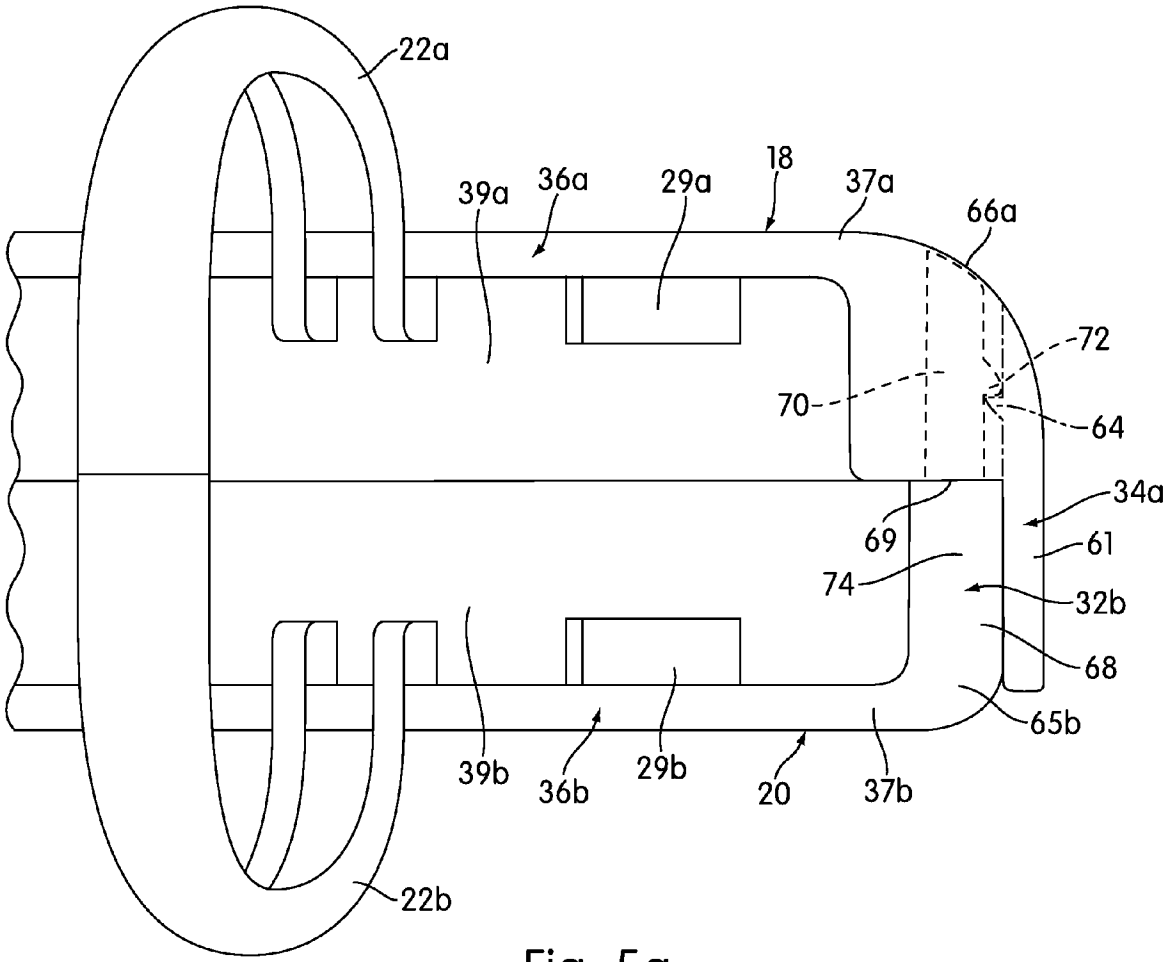
FIG. 5*a* is a detailed view of the ends of the binder assembly in the closed position in accordance with an embodiment.

FIG. 4*b* shows the first end 32*b* of the second binding element 20 in more detail. As shown in FIG. 4*b*, the upper portion 37*b* transitions to the first end 32*b* near the first corner 65*b*. The first end 32*b* includes a side portion 68 and a protruding portion 70 attached to the side portion 68. The protruding portion 70 may have a second engaging member, taking the form of a ridge 72, provided at an end opposite the end attached to the side portion 68. The ridge 72 may be constructed and arranged to engage with the ridge 64 provided on the second end 34*a* of the first binding element 18 when the first and second binding elements 18, 20 are in the closed position, as shown in FIG. 5*a*. That is, the ridge 64 of the first binding element 18 may be constructed to abut against the ridge 72 of the second end 32 of the second binding element 20 to prevent disengagement between the first and second ends 32*b*, 34*a*. Accordingly, the ridge 64 and the ridge 72 may be considered to be latches used to latch or snap together the first and second ends 32*b*, 34*a* of the second and first binding elements 20, 18, respectively. It should be appreciated that the other first and second ends 32*a*, 34*b* may also have latches similarly constructed and arranged as the ridges 64, 72 for latching or snapping together the first and second ends 32*a*, 34*b* of the first and second binding elements, 18, 20, respectively. In the closed position, a portion of the protruding portion 70 of the second binding element 20 may extend into the opening 63 formed at the corner 66*a* of the first binding element 18.

In one embodiment, the cross section of the side portion 68 may be larger than the cross section of the protruding portion 70, thus forming a ledge 74 (see FIG. 4*b*) therebetween. The ledge 74 may be constructed and arranged to abut against the overhang 69 when the first and second binding elements 18, 20 are in the closed position, as shown in FIG. 5*a*. The first and second ends 32*b*, 34*a* may also be made of resilient plastic material. Furthermore, the first end 32*a* of the first binding element 18 and the second end 34*b* of the second binding element 20 may be constructed and arranged in a similar manner as the second end 34*a* of the first binding element 18 and the first end 32*b* of the second binding element 20, described above.

Figure 6A:
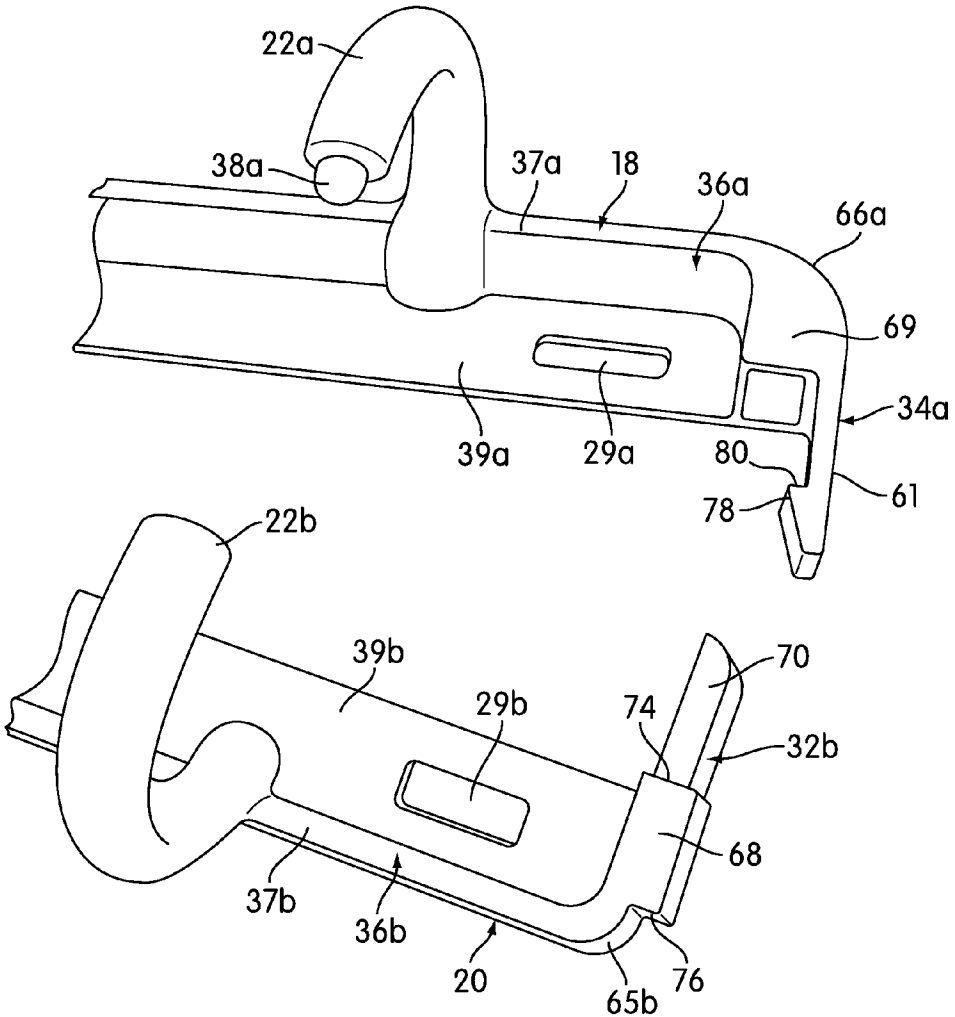
FIG. 6*a* is a detailed view of the ends of the binder assembly in the open position in accordance with another embodiment.

FIG. 6*a* shows another embodiment of the first and second ends 34*a*, 32*b* of the second and first binding elements 20, 18, respectively. In this embodiment, the second end 34*a* is provided with the lip 61. The lip 61 is provided with the first engaging member, taking the form of a sloped protrusion 78 having a flat surface 80 in this embodiment.

Figure 6B:
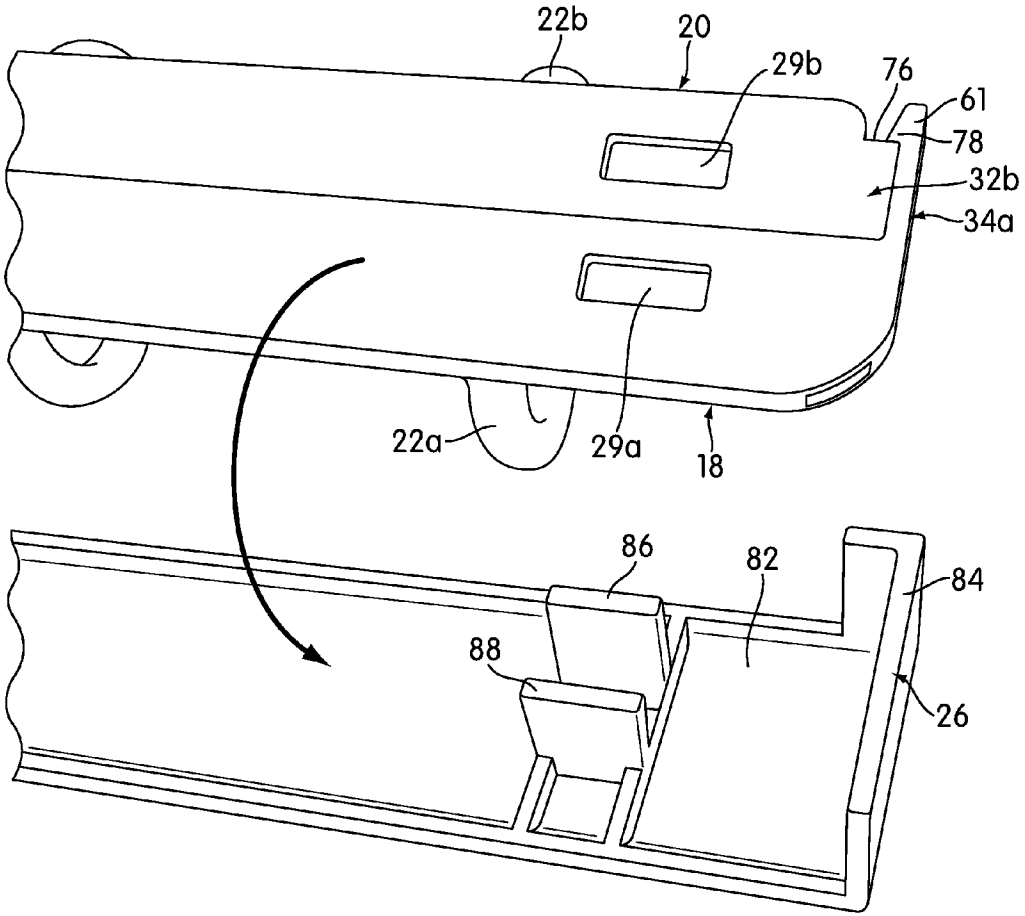
FIG. 6*b* is a detailed view of the binder assembly in accordance with the embodiment shown in FIG. 6*a;*

In the illustrated embodiment, the first end 32*b* may be provided with the side portion 68 and the protruding portion 70 extending from the side portion 68. The ledge 74 is formed between the side portion 68 and the protruding portion 70. The second engaging member, taking the form of a ledge 76 in this embodiment, is formed on the side portion 68 near the corner 65*b*. The ledge 76 of the first end 32*b* is constructed and arranged to abut against the flat surface 80 of the sloped protrusion 78 of the second end 34*a* to prevent disengagement thereof when the first and second binding elements 18, 20 are in the closed position, as shown in FIG. 6*b*. Alternatively, in one embodiment, the sloped protrusion 78 of the second end

34*a* may be received in a recess (not shown) formed in the side portion 68 of the first end 32*b* to prevent disengagement thereof.

FIG. 6*b* also shows an embodiment of the elongated retainer/lock 26. In this embodiment, the retainer/lock 26 includes a base portion 82 and side portions 84 extending generally upwards from the base portion 82. The retainer/lock 26 includes a pair of spaced apart retaining structures 86, 88. The retaining structures 86, 88 are constructed and arranged to be received in the openings 29*a*, 29*b* provided on the first and second binding elements 18, 20 to releasably attach to the first and second binding elements 18, 20 in the closed position thereof, as shown in FIG. 1. That is, the retaining structure 86 is constructed and arranged to engage with the opening 29*a* of the first binding element 18 and the retaining structure 88 is constructed and arranged to engage with the opening 29*b* of the second binding element 20. It is contemplated, however, that the arrangement, number, and location of the openings 29*a*, 29*b* and retaining structures 86, 88 may vary in other embodiments. In this embodiment, the side portion 84 of the retainer/lock 26 may be constructed and arranged to prevent the first ends 34*a*, 34*b* from being disengaged from the 32*a*, 32*b*, which will be described in more detail later.

Figure 7A:
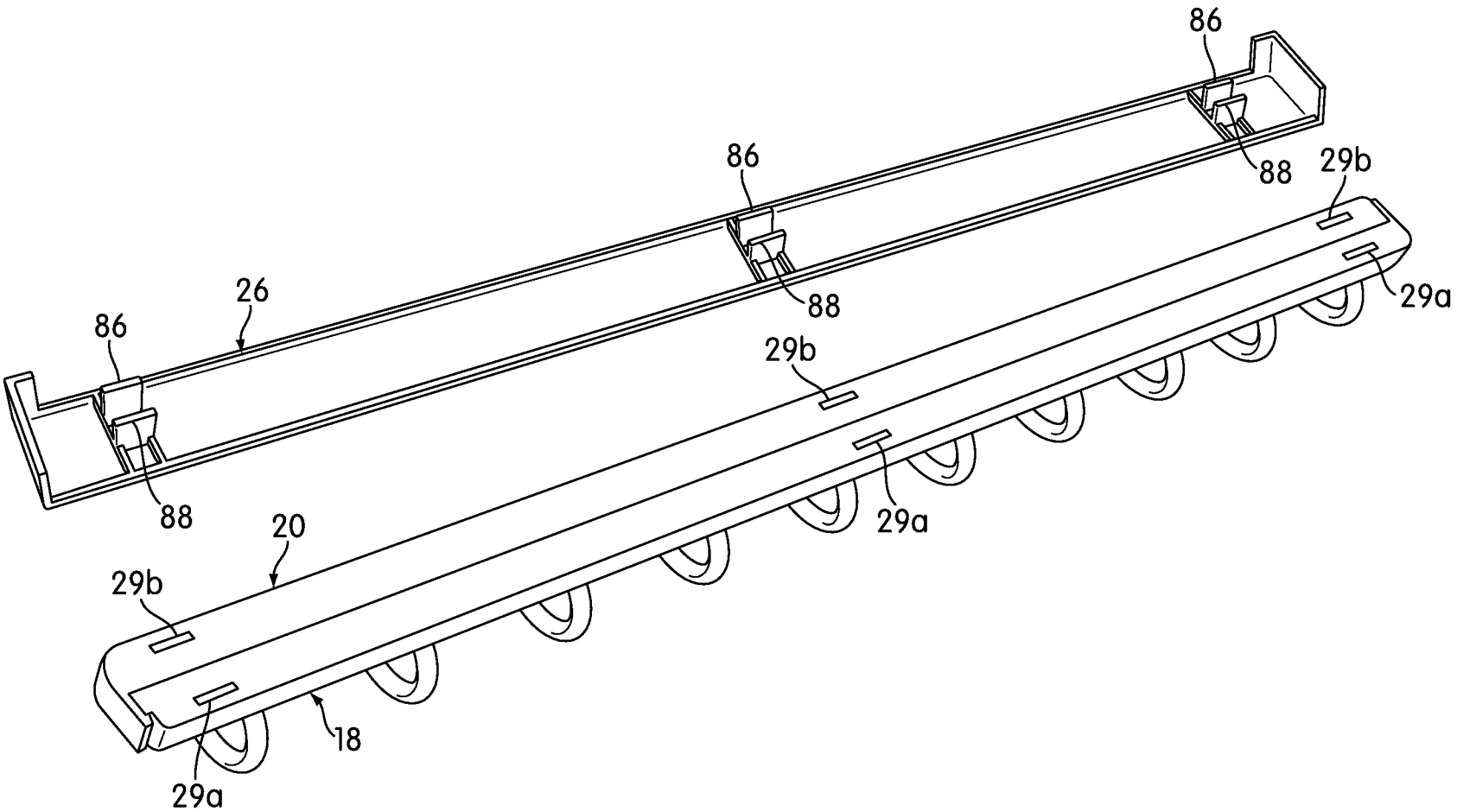
FIG. 7*a* is a perspective view of the binding elements and lock/retainer of the binder assembly in accordance with an embodiment.
Figure 7B:
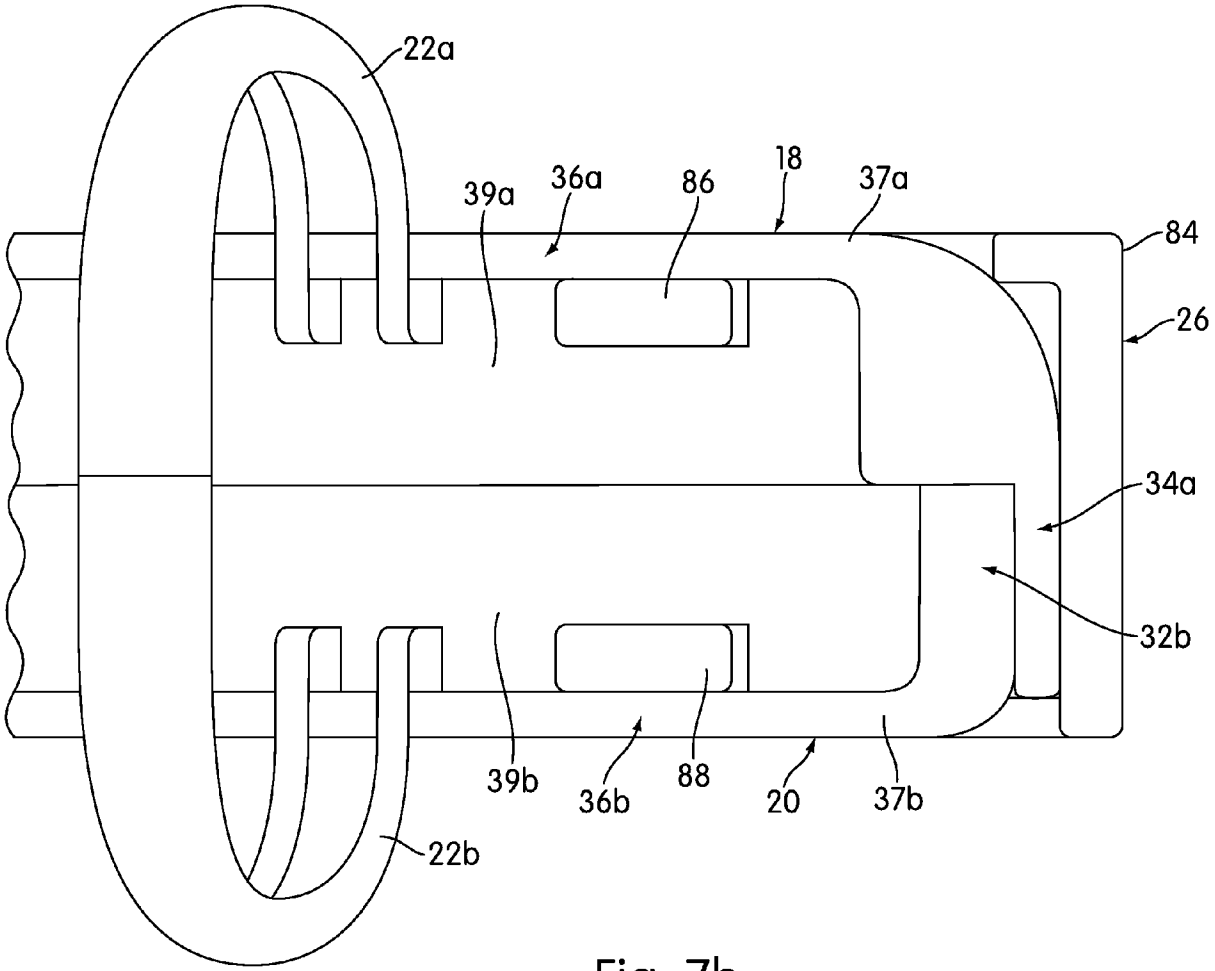
FIG. 7*b* is a detailed view of the binding element and the lock/retainer of the binder assembly in accordance with an embodiment.

FIG. 7*a* shows an embodiment of the retainer/lock 26 and the binding elements 18, 20 in the closed position. In this embodiment, three pairs of retaining structures 86, 88 provided on the retainer/lock 26 are constructed and arranged to engage with the three pairs of openings 29*a*, 29*b* provided on the first and second binding elements 18, 20. When the first and second binding elements 18, 20 are in the closed position, the pairs of openings 29*a*, 29*b* may be aligned with the retaining structures 86, 88. The retaining structures 86, 88 may be provided with teeth or other structures constructed and arranged to grasp onto the lower portion of the 39*a*, 39*b* of the first and second binding elements 18, 20 when the retaining structures 86, 88 are received in the openings 29*a*, 29*b*, as shown in FIG. 7*b*. The retaining structures 86, 88 may also be made of resilient plastic material or other resilient materials.

Figure 8:
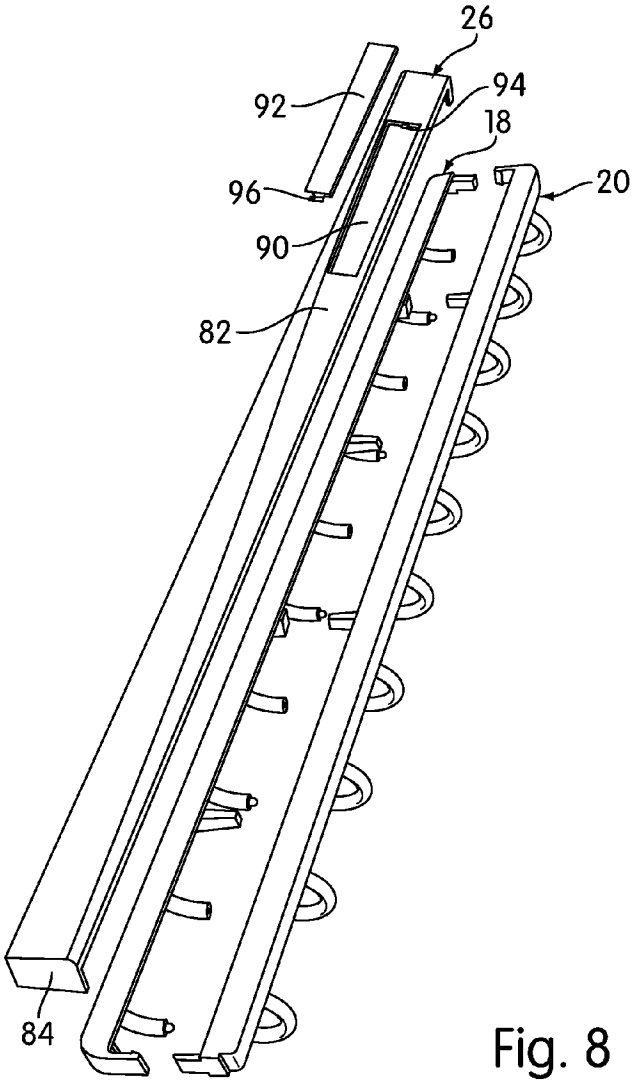
FIG. 8 is an exploded view of the binder assembly in accordance with an embodiment.

FIG. 8 illustrates the retainer/lock 26 and the first and second binding elements 18, 20 in the open position. The retainer/lock 26 may be provided with a channel 90 on the base portion 82 on a side opposite the first and second retaining structures 86, 88. The channel 90 is constructed and arranged to receive a label (not shown) therein. A panel 92, which may be made of transparent plastic material, is constructed and arranged to cover the channel 90 so as to retain the label therein. In this embodiment, the channel 90 is provided with openings 94 (only one is shown in this Figure) constructed and arranged to receive resilient engaging members 96 located on the panel 92. Thus, in one embodiment, the panel 92 may be snap fittingly engaged to the base portion 82 by pushing the panel 92 against the base portion 82 until the engaging members 96 snap into the openings 94. Furthermore, the panel 92 may be removed from the channel 90 by pushing in the engaging members 96 and then lifting the panel 92 from the channel 90. This example, however, is not intended to be limiting and it is contemplated that the panel may have other configurations, size, or location and may be attached to the base portion 82 using other attachment mechanisms.

Figure 9A:
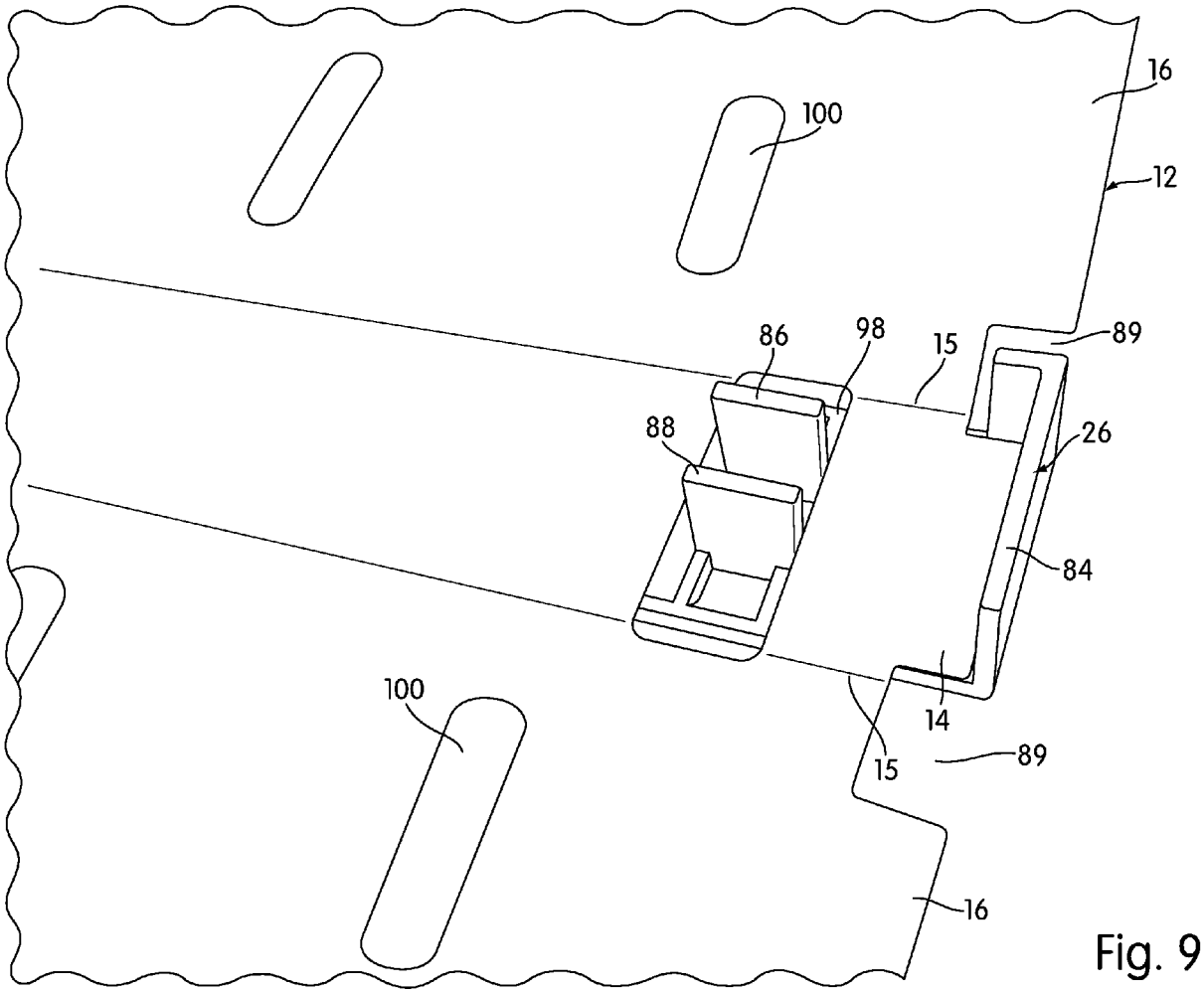
FIG. 9*a* is a detailed view of a cover and lock/retainer of the binder assembly in accordance with an embodiment.
Figure 10A:
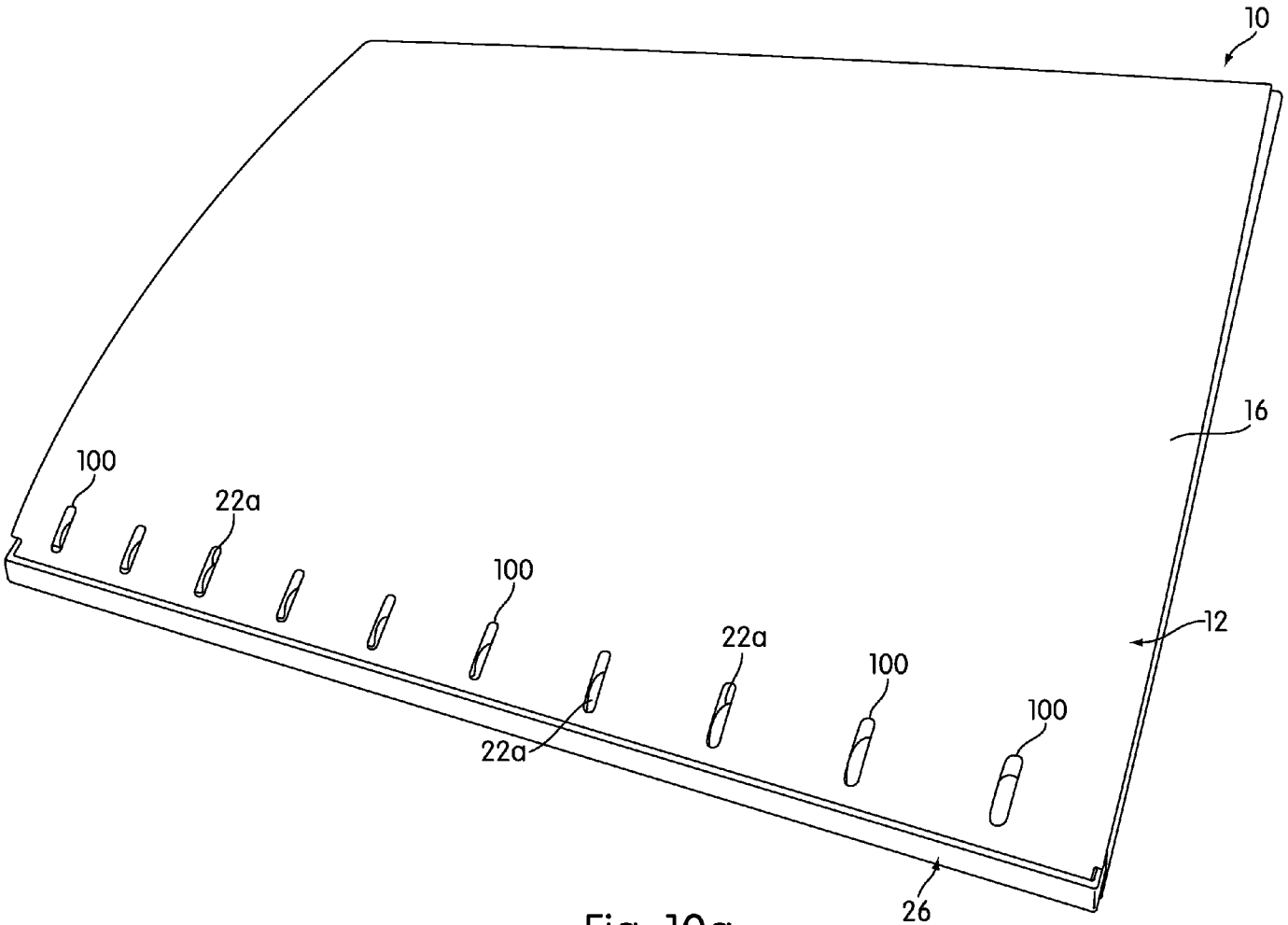
FIG. 10*a* is a perspective view of the binder assembly in accordance with an embodiment.

FIG. 9*a* shows a detailed view of the cover portion 12 and the retainer/lock 26. The spine portion 14 of the cover 12 may be disposed on the base portion 82 of the retainer/lock 26. In such a position, the first and second retaining structures 86, 88 may be received in openings 98 provided in the spine portion 14 of the cover 12. Accordingly, in embodiments having three pairs of first and retaining structures 86, 88, three openings 98 corresponding to the pairs of retaining structures 86, 88 may be provided on the spine portion 14 of the cover 12. Openings 100 may be formed on the cover leaf portions 16 of the cover 12. The openings 100 may be constructed and arranged to receive the first and second retaining fingers 22*a*, 22*b* when the cover 12 is in the closed position, as shown in FIG. 10*a*. Accordingly, the openings 100 may be aligned with and may correspond with the pairs of first and second retaining fingers 22*a*, 22*b*. Cutouts 89 may also be formed in the cover 12 to accommodate the first and second binding elements 18, 20 and the side portion 84 of the retainer/lock 26.

Figure 9B:
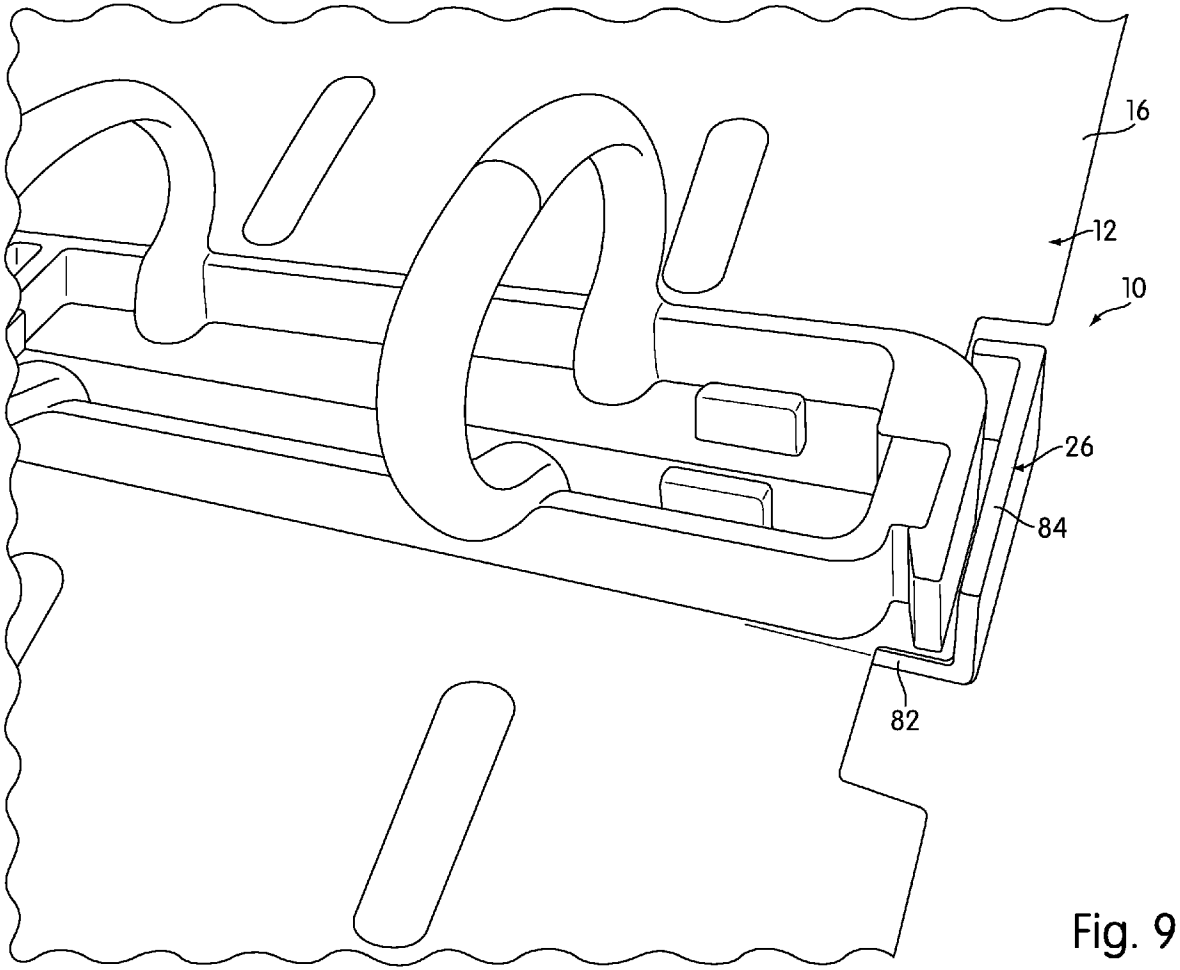
FIG. 9*b* is a detailed view of an assembled cover, lock/retainer, and binding elements of the binder assembly in the closed position in accordance with an embodiment.

FIG. 9*b* shows the binder assembly 10 with the retainer/lock 26 releasably attached to the first and second binding elements 18, 20 in the closed position. The spine portion 14 of the cover 12 is retained between the retainer/lock 26 and the first and second binding elements 18, 20. The retainer/lock 26 is engaged with the first and second binding elements 18, 20 to secure the first and second binding elements 18, 20 in the closed position. Thus, these modular components may be assembled and securely connected to form the binder assembly 10.

Figure 10B:
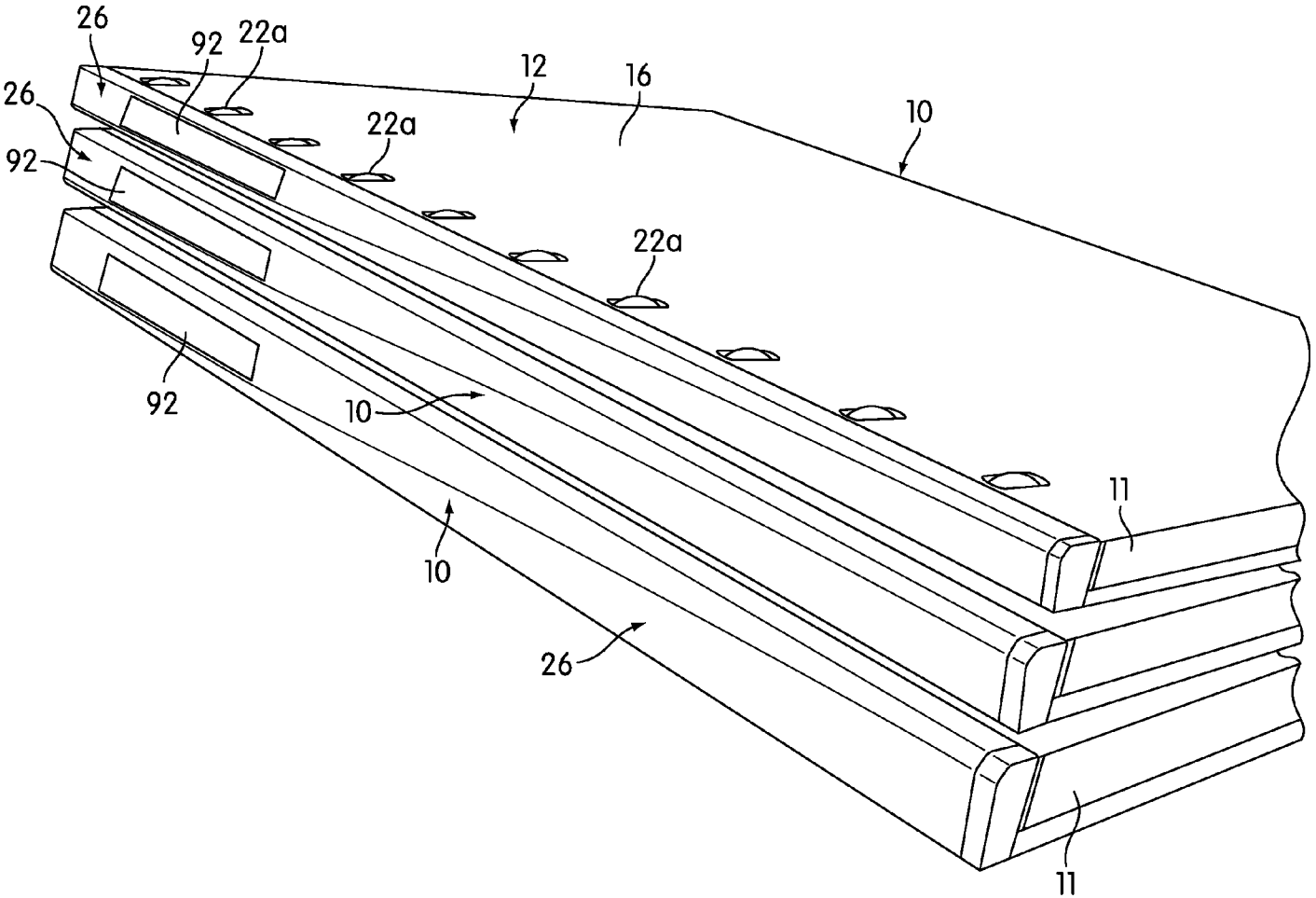
FIG. 10*b* is a perspective view of multiple binder assemblies in accordance with an embodiment.

As shown in FIG. 10*b*, the binder assemblies 10 may be stacked on top of one another. The covers 12 may either be made of plastic, cardboard, other materials, or a combination thereof. The covers 12 may be made of flexible, rigid, or semi-rigid materials, depending on the user's needs. The binding elements 18, 20, the covers 12, and the retainer/lock 26 may be made in various sizes to form the binder assemblies 10 with varying thickness and size.

The binder assembly 10 may be assembled in accordance with an embodiment as follows. The binding elements 18, 20 may initially be unassembled and in the open position as shown in FIG. 2*b*. In the illustrated position, the fingers 22*a* are aligned with the fingers 22*b* and the protrusions 28*a*, 28*b* are aligned with the protrusion receiving structures 30*b*, 30*a*, respectively. Furthermore, the first end 32*a* of the first binding element 18 may be aligned with the second end 34*b* of the second binding element 20, and the second end 34*a* of the first binding element 18 may be aligned with the first end 32*b* of the second binding element 20. The user may mount articles 11 to the binding elements 18 or 20 by inserting the retaining fingers 22*a* or 22*b* through the openings in the articles. The user may then manually move the first and second binding elements 18, 20 towards each other. As the first and second binding elements 18, 20 are pushed towards each other to the closed position, the locating pins 38*a*, 38*b* of the fingers 22*a*, 22*b* of each binding element 18, 20 may snap into the locating pin receiving structure 40*a*, 40*b* on the opposing fingers 22*a*, 22*b* of the other binding element 18, 20. The protrusions 28*a*, 28*b* of each binding element 18, 20 may then snap into the protrusion receiving structures 30*a*, 30*b* located on the other binding element 18, 20. That is, the protrusions 28*a* may snap into the protrusion receiving structures 30*b* and the protrusions 28*b* may snap into the protrusion receiving structures 30*a*. In one embodiment, the user may push the resilient protrusions 28*a*, 28*b* into the space 54 of the protrusion receiving structures 30*a*, 30*b* until the prongs 42*a*, 42*b*, 44*a*, 44*b* snap to retain the retaining structures (not shown) of the protrusion receiving structures 30*a*, 30*b* in the indentations 42*a*, 44*a*, 42*b*, 44*b* thereof. In the closed position, as shown in FIG. 3*c*, the divider 60 of the protrusion receiving structures 30*a*, 30*b* may be received in the space 45 between the prongs 42, 44*b* and the prongs 42*a*, 44*a*, respectively.

Figure 5B:
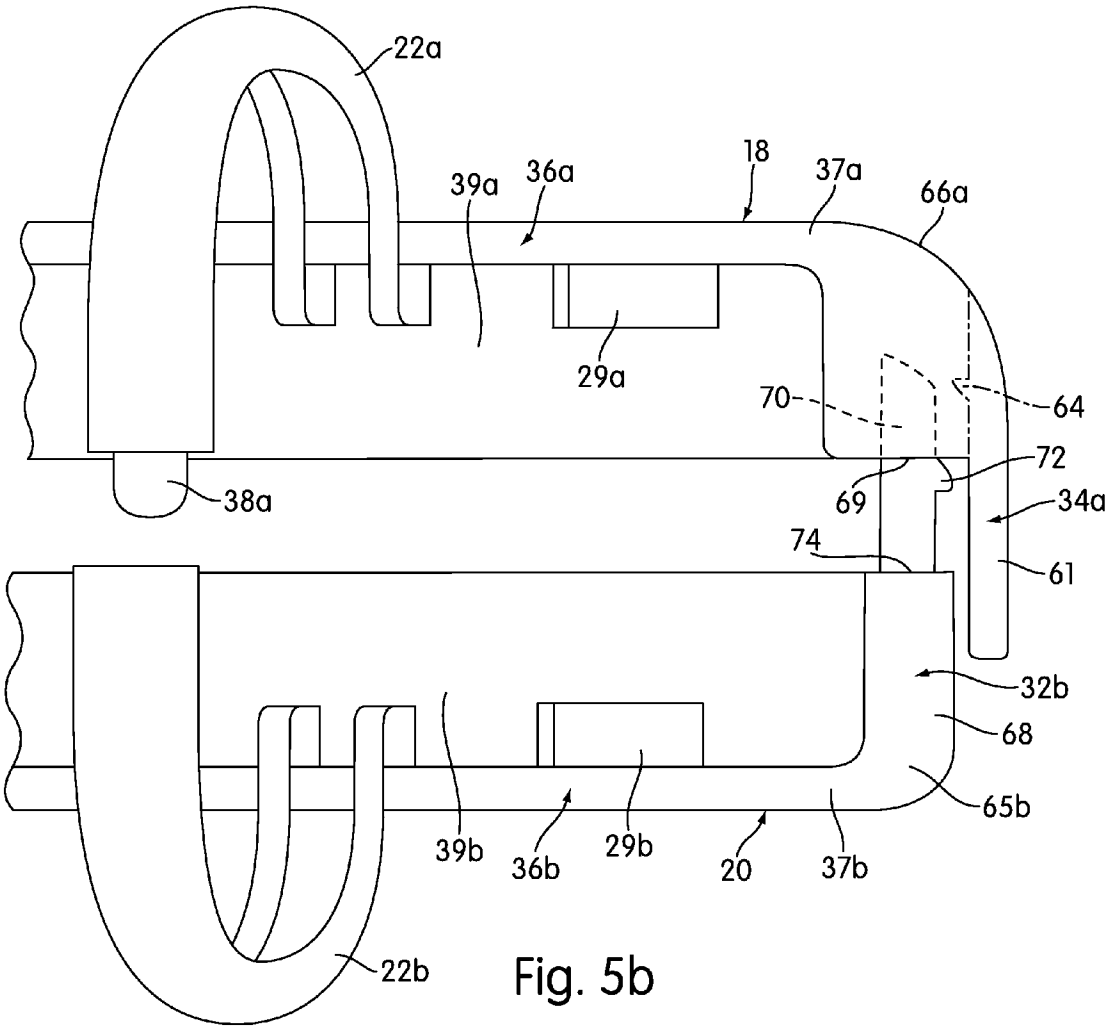
FIG. 5*b* is a detailed view of the ends of the binder assembly in the open position in accordance with an embodiment.

In addition, as shown in FIG. 5*b*, when the first and second binding elements 18, 20 are moved to the closed position, the protruding portions 70 of the first ends 32*a*, 32*b* are pushed towards the engaging members, taking the form of the vertical ridges 64 in this embodiment, of the second ends 34*a*, 34*b*. The resilient protruding portion 70 may be pushed until the ridge 72 formed on the protruding portion 70 snaps to engage with the ridge 64 provided on the second end 34*a*, 34*b* of the other binding element 18, 20, as shown in FIG. 5*a*. In the closed position, at least a portion of the protruding portion 70 of the first ends 32*a*, 32*b* may be disposed under the overhang 69 of the second ends 34*a*, 34*b*.

Alternatively, in the embodiment shown in FIG. 6*a*, the user may push the first ends 32*a*, 32*b* towards the second ends 34*b*, 34*a* until the sloped protrusion 78 of the second ends 34*a*, 34*b* snap into a recess (not shown) formed in the first ends 32*a*, 32*b* or engages with the ledge 76 to prevent the removal of the second ends 34*a*, 34*b* from the first ends 32*b*, 32*a*. Accordingly, the first and second binding elements 18, 20 may be in the closed position, as shown in FIG. 6*b*.

The cover 12 may be placed on the retainer/lock 26, as shown in FIG. 9*a*. The retaining structures 86, 88 may be inserted through the openings 98 formed in the spine portion 14 of the cover 12.

The retainer/lock 26 may be used to secure the first and second binding elements 18, 20 to the spine portion 14 of the cover 12 and to secure the connection between the first and second binding elements 18, 20 as follows. To attach the retainer/lock 26 to the first and second binding elements 18, 20, the retaining structures 86, 88 of the retainer/lock 26 with the cover 12 provided thereon (see FIG. 9*a*) may be pushed through the openings 29*a*, 29*b* formed in the first and second binding elements 18, 20 until the resilient retaining structures 86, 88 snap against the lower portions 39*a*, 39*b* of the first and binding elements 18, 20 to prevent the retaining structures 86, 88 from being removed from the openings 29*a*, 29*b*, as shown in FIG. 7*b* (cover 12 not shown in this Figure). In such an arrangement, the side portions 84 of the retainer/lock 26 prevent access to the first and second ends 32*a*, 32*b*, 34*a*, 34*b*, thus preventing the first and second binding elements 18, 20 from being disengaged by prying or lifting the first and second ends 32*a*, 33*b*, 34*a*, 34*b*. The binder assembly 10 may thus be in the assembled configuration wherein the retainer/lock 26 is attached to the first and second binding elements 18, and 20 and the cover 12 is retained between the retainer/lock 18 and the first and second binding elements 18, 20, as shown in FIG. 1.

The binder assembly 10 may be disassembled in accordance with an embodiment as follows. The user may pull the retainer/lock 26 from the first and second binding element 18, 20 with sufficient force to flex the resilient retaining structures 86, 88 such that the resilient retaining structures 86, 88 are removed from the openings 29*a*, 29*b*. Accordingly, the first and second ends 32*a*, 32*b*, 34*a*, 34*b* are accessible by the user. In one embodiment, the user may then pull on the lip 61 of the first ends 34*a*, 34*b* away from their associated second ends 34*b*, 34*a* such that the vertical ridges 64 of the second ends 34*a*, 34*b* are removed from engagement with the ridges 72 provided on their associated first ends 32*b*, 34*a*. Alternatively, in the embodiment shown in FIG. 6*a*, the lip 61 of the second ends 34*a*, 34*b* may be pulled away from their associated first ends 32*a*, 32*b* until the sloped protrusion 78 is no longer engaged with the ledge 76 or a recess (not shown) formed in the first ends 32*a*, 32*b*. Accordingly, the first and second binding elements 18, 20 may be pulled apart to the open position such that the locating pins 38*a*, 38*b* of the fingers 22*a*, 22*b* of each binding element 18, 20 are removed from the locating pin receiving structure 40*a*, 40*b* on the opposing fingers 22*a*, 22*b* of the other binding element 18, 20. In addition, the protrusions 28*a*, 28*b* of each binding element 18, 20 may then be removed from the protrusion receiving structures 30*a*, 30*b* located on the other binding element 18, 20. In particular, the resilient prongs 42*a*, 42*b*, 44*a*, 44*b*, of each binding element 18, 20 may snap out of their engagement with the retaining structures (not shown) provided on the side walls 56 of the protrusion receiving structures 30*a*, 30*b* on the other binding element 18, 20. As a result, the first and second binder elements 18, 20 may be in the open position wherein articles may be removed or mounted thereto.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A binder assembly for receiving and retaining at least one article with holes formed along an edge thereof, the binder assembly comprising:

a cover comprising a spine portion and at least one cover leaf portion;

a first binder element comprising a plurality of first retaining fingers;

a second binder element comprising a plurality of second retaining fingers, the plurality of first and second retaining fingers being arranged to define a plurality of opposing pairs of the first and second retaining fingers, the first binding element and the second binding element being moveable between 1) an open position wherein ends of the first and second retaining fingers of each pair are disengaged and spaced apart from one another to permit the at least one article to be removed from or mounted to the binder assembly by engaging or disengaging the holes and the first and second retaining fingers, and 2) a closed position wherein the ends of the first and second retaining fingers of each pair are engaged together to prevent the at least one article mounted to the binder assembly from being removed; and an elongated retainer/lock constructed to releasably attach to the first and second binding elements in the closed position thereof with the spine portion of the cover therebetween for locking the first and second binding elements in the closed position and securing the first and second binding elements to the spine portion of the cover.

2. The binder assembly of claim 1, wherein the first and second binding elements each comprises a plurality of locking protrusions constructed and arranged to engage with a plurality of protrusion receiving structures on the opposing first and second binding elements.

3. The binder assembly of claim 2, wherein the first and second binding elements are constructed and arranged to engage with one other by snap fitting the locking protrusions with the plurality of protrusion receiving structures.

4. The binder assembly of claim 2, wherein the plurality of locking protrusions and the plurality of protrusion receiving structures of the first and second binding elements are constructed and arranged such that when the first and second binding elements are positioned to be moved to the engaged position, the plurality of locking protrusions of each of the first and second binder elements are aligned with the plurality of locking protrusions of the other of the first and second binder elements.

5. The binder assembly of claim 2, wherein each locking protrusion comprises two prongs and each protrusion receiving structure comprises an opening constructed and arranged to receive the two prongs of the locking protrusion.

6. The binder assembly of claim 1, wherein the first and second binding elements are constructed and arranged to have the same configuration.

7. The binder assembly of claim 1, wherein the elongated retainer/lock comprises a plurality of protrusions, and wherein the first and second binding elements each comprise a plurality of openings constructed and arranged to engage with the protrusions of the elongated retainer/lock.

8. The binder assembly of claim 7, wherein the spine portion of the cover comprises openings constructed and arranged to receive the plurality of protrusions of the elongated retainer/lock such that the cover is retained between the elongated retainer/lock and the first and second binding elements when the elongated retainer/lock is engaged with the first and second binding elements.

9. The binder assembly of claim 1, wherein the first and second binder elements each comprise a first end and a second end, the first retaining fingers located between the first and second end of the first binder element and the second retaining fingers located between the first and second end of the second binder element.

10. The binder assembly of claim 9, wherein the first end of each of the first and second binder elements comprises a first locking tab and the second end of each of the first and second binder elements comprises a second locking tab constructed and arranged to engage with the first locking tab of the other of the first and second binder elements.

11. The binder assembly of claim 10, wherein the first and second locking tabs of the first and second binding elements each comprises a resilient material.

12. The binder assembly of claim 1, wherein each of the first and second retaining fingers take the form of ring segments.

13. The binder assembly of claim 12, wherein in the engaged position, the opposing pairs of first and second retaining fingers take the form of rings.

14. The binder assembly of claim 1, wherein the cover comprises two cover leaf portions constructed and arranged to hold the articles therebetween when the cover is retained between the elongated retainer/lock and the first and second binding elements.

15. The binder assembly of claim 1, wherein each cover leaf portion comprises a plurality of recesses constructed and arranged to receive the first and second retaining fingers.

16. The binder assembly of claim 1, further comprising a transparent panel constructed and arranged to engage with the elongated retainer/lock.

17. A binder assembly for receiving and retaining at least one article with holes formed along an edge thereof, the binder assembly connectable to a cover having a spine portion and at least one cover leaf portion, the binder assembly comprising:

a first binder element comprising a plurality of first retaining fingers;

a second binder element comprising a plurality of second retaining fingers, the plurality of first and second retaining fingers being arranged to define a plurality of opposing pairs of the first and second retaining fingers, the first binding element and the second binding element being moveable between 1) an open position wherein ends of the first and second retaining fingers of each pair are disengaged and spaced apart from one another to permit the at least one article to be removed from or mounted to the binder assembly by engaging or disengaging the holes and the first and second retaining fingers, and 2) a closed position wherein the ends of the first and second retaining fingers of each pair are engaged together to prevent the at least one article mounted to the binder assembly from being removed; and an elongated retainer/lock constructed to releasably attach to the first and second binding elements in the closed position thereof with the spine portion of the cover therebetween for locking the first and second binding elements in the closed position and securing the first and second binding elements to the spine portion of the cover.

18. The binder assembly of claim 17, wherein the first and second binding elements each comprises a plurality of locking protrusions constructed and arranged to engage with a plurality of protrusion receiving structures on the opposing first and second binding elements.

19. The binder assembly of claim 18, wherein the first and second binding elements are constructed and arranged to engage with one other by snap fitting the locking protrusions with the plurality of protrusion receiving structures.

20. The binder assembly of claim 18, wherein the plurality of locking protrusions and the plurality of protrusion receiving structures of the first and second binding elements are constructed and arranged such that when the first and second binding elements are positioned to be moved to the engaged position, the plurality of locking protrusions of each of the first and second binder elements are aligned with the plurality of locking protrusions of the other of the first and second binder elements.

21. The binder assembly of claim 18, wherein each locking protrusion comprises two prongs and each protrusion receiving structure comprises an opening constructed and arranged to receive the two prongs of the locking protrusion.

22. The binder assembly of claim 17, wherein the first and second binding elements are constructed and arranged to have the same configuration.

23. The binder assembly of claim 17, wherein the elongated retainer/lock comprises a plurality of protrusions, and wherein the first and second binding elements each comprise a plurality of openings constructed and arranged to engage with the protrusions of the elongated retainer/lock.

24. The binder assembly of claim 23, wherein the plurality of protrusions of the elongated retainer/lock are received in openings formed in the spine portion of the cover such that the cover is retained between the elongated retainer/lock and the first and second binding elements when the elongated retainer/lock is engaged with the first and second binding elements.

25. The binder assembly of claim 17, wherein the first and second binder elements each comprise a first end and a second end, the first retaining fingers located between the first and second end of the first binder element and the second retaining fingers located between the first and second end of the second binder element.

26. The binder assembly of claim 25, wherein the first end of each of the first and second binder elements comprises a first locking tab and the second end of each of the first and second binder elements comprises a second locking tab constructed and arranged to engage with the first locking tab of the other of the first and second binder elements.

27. The binder assembly of claim 26, wherein the first and second locking tabs of the first and second binding elements each comprises a resilient material.

28. The binder assembly of claim 17, wherein each of the first and second retaining fingers take the form of ring segments.

29. The binder assembly of claim 28, wherein in the engaged position, the opposing pairs of first and second retaining fingers take the form of rings.

30. The binder assembly of claim 17, further comprising a transparent panel constructed and arranged to engage with the elongated retainer/lock.

* * * * *